US009103206B2

(12) United States Patent
Alberty et al.

(10) Patent No.: US 9,103,206 B2
(45) Date of Patent: Aug. 11, 2015

(54) METHODS OF INCREASING FRACTURE RESISTANCE IN LOW PERMEABILITY FORMATIONS

(75) Inventors: Mark William Alberty, Houston, TX (US); Mark Aston, Teddington (GB); Jim Friedheim, Spring, TX (US); Mark Sanders, Houston, TX (US); Randall Sant, Houston, TX (US)

(73) Assignees: M-I LLC, Houston, TX (US); BP Corporation North America Inc., Warrenville, IL (US)

( * ) Notice: Subject to any disclaimer, the term of this patent is extended or adjusted under 35 U.S.C. 154(b) by 617 days.

(21) Appl. No.: 12/669,967

(22) PCT Filed: Aug. 1, 2008

(86) PCT No.: PCT/US2008/071978

§ 371 (c)(1),
(2), (4) Date: May 19, 2010

(87) PCT Pub. No.: WO2009/018536

PCT Pub. Date: Feb. 5, 2009

(65) Prior Publication Data

US 2010/0282470 A1 Nov. 11, 2010

Related U.S. Application Data

(60) Provisional application No. 60/953,387, filed on Aug. 1, 2007.

(51) Int. Cl.
*E21B 43/26* (2006.01)
*E21B 33/138* (2006.01)

(52) U.S. Cl.
CPC ..... *E21B 43/26* (2013.01); *E21B 33/138* (2013.01)

(58) Field of Classification Search
CPC ..... E21B 33/138; E21B 43/26
USPC ..... 166/281
See application file for complete search history.

(56) References Cited

U.S. PATENT DOCUMENTS 5,604,184 A 2/1997 Ellis et al.
5,839,510 A * 11/1998 Weaver et al. ..... 166/276

(Continued)

FOREIGN PATENT DOCUMENTS

WO WO 2005012687 A1 * 2/2005 ..... E21B 33/13
WO 2008/134359 A1 11/2008
WO 2008/134371 A2 11/2008

OTHER PUBLICATIONS

International Search Report from PCT/US2008/071978 dated Mar. 17, 2009 (4 pages).

(Continued)

*Primary Examiner* — Zakiya W Bates
*Assistant Examiner* — Silvana Runyan
(74) *Attorney, Agent, or Firm* — Osha Liang LLP

(57) ABSTRACT

A method of increasing the fracture resistance of a low permeability formation that includes emplacing a wellbore fluid in a wellbore through the low permeability formation, the wellbore fluid comprising: a settable carrier fluid; and a solid particulate bridging material; increasing the pressure in the wellbore such that fractures are formed in the formation; allowing the settable carrier fluid to enter the fractures; bridging and sealing the mouths of the fractures to form a substantially impermeable bridge proximate the mouth of the fractures thereby strengthening the formation; and holding the increased pressure for an amount of time sufficient for setting of the carrier fluid in the fractures is disclosed.

37 Claims, 5 Drawing Sheets

(56) References Cited

U.S. PATENT DOCUMENTS

| | | | | |
|---|---|---|---|---|
| 5,921,317 | A | 7/1999 | Dewprashad et al. | |
| 6,448,206 | B1 * | 9/2002 | Griffith et al. | 507/219 |
| 6,837,309 | B2 | 1/2005 | Boney et al. | |
| 6,976,537 | B1 | 12/2005 | Verret | |
| 7,114,560 | B2 * | 10/2006 | Nguyen et al. | 166/249 |
| 7,143,828 | B2 * | 12/2006 | Reddy et al. | 166/294 |
| 7,934,557 | B2 * | 5/2011 | Nguyen | 166/295 |
| 2003/0201103 | A1 * | 10/2003 | Brookey et al. | 166/283 |
| 2004/0094299 | A1 | 5/2004 | Jones | |
| 2005/0000690 | A1 | 1/2005 | Boney | |
| 2005/0109506 | A1 | 5/2005 | Slabaugh et al. | |
| 2006/0254826 | A1 | 11/2006 | Alberthy | |
| 2007/0039732 | A1 * | 2/2007 | Dawson et al. | 166/270 |
| 2007/0249504 | A1 | 10/2007 | Ballard | |
| 2007/0287767 | A1 * | 12/2007 | Ballard | 523/130 |

OTHER PUBLICATIONS

Written Opinion from PCT/US2008/071978 dated Mar. 17, 2009 (6 pages).

Aston, M.S. et al.; "Drilling Fluids for Wellbore Strengthening"; ADC/SPE 87130; Society of Petroleum Engineers; ADC/SPE Drilling Conference, Dallas, Texas USA; Mar. 2-4, 2004 (7 pages).

Alberty, Mark W. et al.; "A New Treatment for Wellbore Strengthening in Shale"; SPE 110713; Society of Petroleum Engineers; 2007 SPE Annual Technical Conference and Exhibition, Anaheim, California; Nov. 11-14, 2007 (8 pages).

Alberty, M.W. et al.; "Fracture Gradients in Depleted Reservoirs—Drilling Wells in Late Reservoir Life"; SPE/IADC 67740; Society of Petroleum Engineers; SPE/IADC Drilling Conference, Amsterdam, The Netherlands; Feb. 27-Mar. 1, 2001; (8 pages).

Alberty, Mark W. et al.; "A Physical Model for Stress Cages"; Society of Petroleum Engineers; SPE Annual Technical Conference and Exhibition, Houston, Texas USA; Sep. 26-29, 2004 (8 pages).

Gil, I. et al.; "Wellbore Cooling as a Means to Permanently Increase Fracture Gradient"; SPE 103256; Society of Petroleum Engineers; SPE Annual Technical Conference and Exhibition, San Antonio, Texas; Sep. 24-27, 2006 (7 pages).

Office Action issued in corresponding Eurasian Application No. 201070208/13 dated Mar. 6, 2012 (3 pages).

Office Action issued in corresponding Eurasian Application No. 2420-166073EA dated Oct. 3, 2011 (2 pages).

Office Action issued in corresponding Canadian Application No. 2,694,511 dated Jan. 11, 2012 (2 pages).

Office Action for Canadian Application No. 2,694,511 dated Nov. 1, 2012 (2 pages).

Extended European Search Report issued in corresponding European application No. 08797045.5 mailed May 20, 2014 (5 pages).

Office Action in counterpart Mexican Patent Application No. MX/a/2010/001144 with English correspondence reporting the same; dated Jun. 5, 2014 (6 pages).

Office Action in counterpart Argentine Patent Application No. P080103365 with English correspondence reporting the same; dated Jun. 12, 2014 (4 pages).

Office Action issued in corresponding Mexican application No. MX/a/2010/001144, mailed Jan. 7, 2015, with English communication reporting the same (8 pages).

* cited by examiner

METHODS OF INCREASING FRACTURE RESISTANCE IN LOW PERMEABILITY FORMATIONS

BACKGROUND OF INVENTION

1. Field of the Invention

Embodiments disclosed herein relate generally to methods of increasing the fracture resistance of low permeability formations.

2. Background Art

During the drilling of a wellbore, various fluids are typically used in the well for a variety of functions. The fluids may be circulated through a drill pipe and drill bit into the wellbore, and then may subsequently flow upward through wellbore to the surface. Common uses for well fluids include: lubrication and cooling of drill bit cutting surfaces while drilling generally or drilling-in (i.e., drilling in a targeted petroliferous formation), transportation of "cuttings" (pieces of formation dislodged by the cutting action of the teeth on a drill bit) to the surface, controlling formation fluid pressure to prevent blowouts, maintaining well stability, suspending solids in the well, minimizing fluid loss into and stabilizing the formation through which the well is being drilled, fracturing the formation in the vicinity of the well, displacing the fluid within the well with another fluid, cleaning the well, testing the well, transmitting hydraulic horsepower to the drill bit, fluid used for emplacing a packer, abandoning the well or preparing the well for abandonment, and otherwise treating the well or the formation.

Wellbore fluids may also be used to provide sufficient hydrostatic pressure in the well to prevent the influx and efflux of formation fluids and wellbore fluids, respectively. When the pore pressure (the pressure in the formation pore space provided by the formation fluids) exceeds the pressure in the open wellbore, the formation fluids tend to flow from the formation into the open wellbore. Therefore, the pressure in the open wellbore is typically maintained at a higher pressure than the pore pressure. While it is highly advantageous to maintain the wellbore pressures above the pore pressure, on the other hand, if the pressure exerted by the wellbore fluids exceeds the fracture resistance of the formation, a formation fracture and thus induced mud losses may occur. Further, with a formation fracture, when the wellbore fluid in the annulus flows into the fracture, the loss of wellbore fluid may cause the hydrostatic pressure in the wellbore to decrease, which may in turn also allow formation fluids to enter the wellbore. As a result, the formation fracture pressure typically defines an upper limit for allowable wellbore pressure in an open wellbore while the pore pressure defines a lower limit. Therefore, a major constraint on well design and selection of drilling fluids is the balance between varying pore pressures and formation fracture pressures or fracture gradients though the depth of the well.

A particularly challenging situation arises in depleted reservoirs, in which pressure depleted formations are neighbored by or inter-bedded with normally or abnormally pressured zones. For example, high permeability pressure depleted sands may be neighbored by high pressured low permeability rocks, such as shale or high pressure sands. This can make the drilling of certain depleted zones nearly impossible because the mud weight required to support the shale exceeds the fracture resistance of the pressure depleted sands and silts.

Thus, wellbore strengthening techniques, ranging from use of cements, resins, casing drilling, and managed pressure drilling, etc, have seen recent increases in application and further development. In the drilling of the depleted zones described above, wellbore strengthening techniques have been used in hopes of increasing the fracture resistance of weaker formations, which may allow for more efficient and economic drilling.

Accordingly, there exists a continuing need for developments in wellbore strengthening.

SUMMARY OF INVENTION

In one aspect, embodiments disclosed herein relate to a method of increasing the fracture resistance of a low permeability formation that includes emplacing a wellbore fluid in a wellbore through the low permeability formation, the wellbore fluid comprising: a settable carrier fluid; and a solid particulate bridging material; increasing the pressure in the wellbore such that fractures are formed in the formation; allowing the settable carrier fluid to enter the fractures; bridging and sealing the mouths of the fractures to form a substantially impermeable bridge proximate to the mouth of the fractures thereby strengthening the formation; and holding the increased pressure for an amount of time sufficient for setting of the carrier fluid in the fractures.

In another aspect, embodiments disclosed herein relate to a method of drilling a wellbore through a low permeability formation that includes drilling the wellbore while circulating a first wellbore fluid into the wellbore; emplacing a wellbore fluid in a wellbore through the low permeability formation, the wellbore fluid comprising: a settable carrier fluid; and a solid particulate bridging material; increasing the pressure in the wellbore such that fractures are formed in the formation; allowing the settable carrier fluid to enter the fractures; bridging and sealing the mouths of the fractures to form a substantially impermeable bridge proximate the mouth of the fractures thereby strengthening the formation; and holding the increased pressure for an amount of time sufficient for setting of the carrier fluid in the fractures.

In yet another aspect, embodiments disclosed herein relate to a method of increasing the fracture resistance of a low permeability formation that includes emplacing a wellbore fluid in a wellbore through the low permeability formation, the wellbore fluid comprising: a settable carrier fluid comprising an oleaginous base fluid, an epoxidized natural oil, and at least one crosslinking agent; a solid particulate bridging material; and a bridge sealing material; increasing the pressure in the wellbore to above an initial or re-opening fracture pressure of the formation such that fractures are induced in the formation; allowing the settable carrier fluid to enter the fractures, the solid particulate bridging material to prop open the fractures, and the bridge sealing material to form a substantially fluid impermeable bridge proximate the mouths of the fractures, thereby strengthening the formation and preventing the fractures from further growth in length; and holding the increased pressure for an amount of time sufficient for setting of the carrier fluid in the fractures.

In yet another aspect, embodiments disclosed herein relate to a method of increasing the fracture resistance of a low permeability formation that includes emplacing a wellbore fluid in a wellbore through the low permeability formation, the wellbore fluid comprising: a settable carrier fluid comprising water and a cementious material; a solid particulate bridging material; and a bridge sealing material; increasing the pressure in the wellbore to above an initial or re-opening fracture pressure of the formation such that fractures are induced in the formation; allowing the settable carrier fluid to enter the fractures, the solid particulate bridging material to prop open the fractures, and the bridge sealing material to form a substantially fluid impermeable bridge proximate the mouths of the fractures, thereby strengthening the formation and preventing the fractures from further growth in length; and holding the increased pressure for an amount of time sufficient for setting of the carrier fluid in the fractures.

Other aspects and advantages of the invention will be apparent from the following description and the appended claims.

DETAILED DESCRIPTION

Methods of strengthening permeable formations have been demonstrated, published, and practiced. However, as the formation permeability decreases, these methods have not proven to be long lasting or enduring. Specifically, as the permeability approaches a lower limit of 1 mD, successes in the strengthening techniques have dwindled. Thus, in one aspect, embodiments disclosed herein relate to methods of increasing the fracture resistance of a wellbore wall during drilling operations through a low permeability formation. As used herein, the term "low permeability formation" refers to a formation possessing a permeability of less than 1 mD.

In particular, embodiments disclosed herein relate to inducing (or reopening), and subsequently sealing, fractures in a wellbore wall to form a stress cage. Without being bound to any particular mechanism, the mechanism through which the stress cage approach is thought to strengthen a wellbore is discussed below. Specifically, as used herein, "stress cage" refers to a wellbore strengthening approach of increasing the hoop stress around the wellbore by propping open or bridging and sealing shallow fractures at the wellbore/formation interface, isolating the fluid pressure in the wellbore from a majority of the fracture. Conventionally, stress cage models have relied on the formation to be sufficiently permeable relative to the sealing efficiency of the blockage such that the fluid behind the bridge or seal will dissipate into the permeable formation. Thus, the pressure in the isolated portion of the fracture will dissipate with the dissipating fluid, ultimately to the formation pore pressure, and the fracture will attempt to close. The compression from this attempted closure of the fracture onto the blockage increases the hoop stress in the wellbore wall region. The increased compressive stress in the near wellbore region of the formation results in the wall of the wellbore having a greater resistance to further fracturing. Such theories and mechanisms are described, for example, in U.S. Patent Publication No. 2006/0254826, "Drilling Fluids for Wellbore Strengthening" IADC/SPE 87130 (2004), and "A Physical Model for Stress Cages" SPE 90493 (2004), which are herein incorporated by reference in their entirety. However, it has previously been asserted that such techniques "do not work" in impermeable formation. See "Fracture Closure Stress (FCS) and Lost Returns Practices," IADC/SPE 92192 (2005).

Figure 1A:
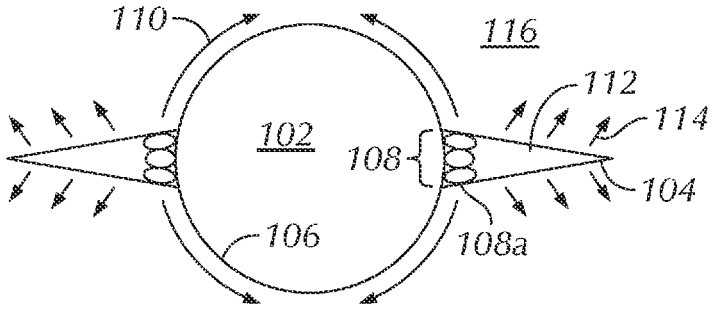
FIGS. 1A and 1B show schematics of stress cages in high and low permeability formations, respectively.
Figure 1B:
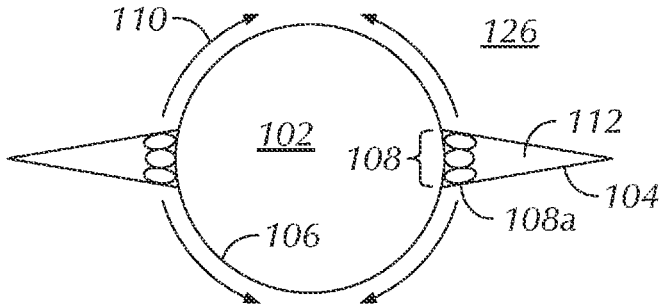

Referring to FIGS. 1A and 1B, schematics of wellbores through high and low permeability formations, respectively, are shown in accordance with the postulated stress cage model. As shown in FIGS. 1A and 1B, a wellbore fluid (not shown separately) containing particulate matter (including bridging materials) is circulated in a wellbore 102, inducing fractures 104 in the walls 106 of wellbore 102. A bridge 108 of bridging materials 108*a* forms in the mouths of fractures 104 to hold fractures 104 open. By holding fractures 104 open with bridge 108, the adjacent rock may be put into compression and an increase in the hoop stress 110 may be observed. As shown in FIG. 1A, which demonstrates a stress cage in a high permeability formation such as sands, the fluid 112 that passes through bridging materials 108*a* (either before or after the formation of the plug) may leak away 114 into the formation matrix 116. Thus, no or little pressure build up within the fracture 104 may be expected, and the fracture 104 does not propagate. Further, nor does fluid trapped behind the bridge attempt to flow back into the well when wellbore pressures decrease.

As shown in FIG. 1B, however, which demonstrates a stress cage in a low permeability formation such as shale, fluid 112 within fracture 104 is not expected to leak away into formation matrix 126 due to the low permeability of formation 126. It had previously been postulated that in order to prevent pressure transfer into the formation and fracture propagation, the bridge 108 should possess an extremely low peuneability to prevent additional fluid build-up in fracture 104 which would increase fracture propagation and destabilize the wellbore. However, the inventors of the present application have recognized that while a conventional stress cage treatment (with a greater concentration of bridging materials) may initially seal a fracture in a low permeability formation, the bridge may likely not be held strong enough to survive subsequent circulation of a fluid within the wellbore or temporary reductions in wellbore pressure resulting from normal drilling activities, and thus, have no long-term stress cage or strengthening effects. In view of such studies, the inventors of the present application have advantageously discovered an approach by which to initially bridge and seal a fracture in a low permeability formation and to also retain such seal during subsequent downhole operations.

Thus, in one embodiment of the present disclosure, strengthening of a wellbore through a low permeability formation may be achieved by using a wellbore fluid comprising bridging materials (or "stress cage solids" as frequently referred to in the art) carried by a settable or solidifiable carrier fluid to bridge fractures induced in a wellbore wall. Optionally, a bridge sealing material may also be included in the wellbore for assisting in the sealing of the bridge. Such methods of treating and/or strengthening a wellbore may be applied in wellbore drilled with oil- or water-based fluids.

In particular, a fluid of the present disclosure containing a settable carrier fluid and bridging materials may be introduced into the wellbore as a "pill" and may be squeezed into a low permeability formation at an increased pressure, in particular, at a pressure above the initial fracture pressure or re-open pressure of the formation. Thus, with the increased pressure, fractures are induced (or reopened) in the wellbore wall, and the bridging particulate material contained within the pill may bridge and seal the induced fractures at or near the mouth thereof. The increased pressure may then be held while the pill sets, which may vary, as described below, depending on the type of settable fluid used. After strengthening the weak formation, the drilling assembly may be run back in the hole and drilling of the wellbore may be continued using a conventional drilling mud.

The bridging materials used to bridge the fracture in accordance with the methods of the present disclosure include those types of materials that are conventionally used in stress caging of high permeability formations. For example, bridging material that is carried by the carrier fluid to bridge the fractures may include at least one substantially crush resistant particulate solid such that the bridging material props open the fractures (cracks and fissures) that are induced in the wall of the wellbore. As used herein, "crush resistant" refers to a bridging material is physically strong enough to withstand the closure stresses exerted on the fracture bridge. Examples of bridging materials suitable for use in the present disclosure include graphite, calcium carbonate (preferably, marble), dolomite ($MgCO_3.CaCO_3$), celluloses, micas, proppant materials such as sands or ceramic particles and combinations thereof. Further, it is also envisaged that a portion of the bridging material may comprise drill cuttings having the desired average particle diameter in the range of 25 to 2000 microns.

The concentration of the bridging material may vary depending, for example, on the type of fluid used, and the wellbore/formation in which the bridging materials are used. However, the concentration should be at least great enough for the bridging material to rapidly bridge the fractures (i.e. cracks and fissures) that are induced in the wall of the wellbore but should not be so high as to make placement of the fluid impractical. Suitably, the concentration of bridging material in the drilling mud should such that the bridging material enters and bridges the fracture before the fracture grows to a length that stresses are no longer concentrated near the borehole. This length is optimally on the order of one-half the wellbore radius but may, in other embodiments, be longer or shorter. In one embodiment, the concentration of bridging particles may be carried at an overly high concentration to ensure that appropriately sized particles do bridge and seal the fracture before the fracture grows in length well beyond the well. Thus, to ensure a sufficiently high concentration, in some embodiments, the concentration of bridging particles may be at least 5 pounds per barrel, at least 10 pounds per barrel, at least 15 pounds per barrel, and at least 30 pounds per barrel in various other embodiments. However, as discussed below, where the drilling mud is employed in a "pill" treatment, it may be desirable that concentration of the bridging particulate material be greater than 50 pounds per barrel in one embodiment, and greater than 80 pounds per barrel in another embodiment.

The sizing of the bridging material may also be selected based size of the fractures predicted for a given formation. In one embodiment, the bridging material has an average particle diameter in the range of 50 to 1500 microns, and from 250 to 1000 microns in another embodiment. The bridging material may comprise substantially spherical particles; however, it is also envisaged that the bridging material may comprise elongate particles, for example, rods or fibers. Where the bridging material comprises elongate particles, the average length of the elongate particles should be such that the elongate particles are capable of bridging the induced fractures at or near the mouth thereof. Typically, elongate particles may have an average length in the range 25 to 2000 microns, preferably 50 to 1500 microns, more preferably 250 to 1000 microns. The bridging material is sized so as to readily form a bridge at or near the mouth of the induced fractures. Typically, the fractures that are induced in the wellbore wall have a fracture width at the mouth in the range 0.1 to 5 mm. However, the fracture width may be dependent, amongst other factors, upon the strength (stiffness) of the formation rock and the extent to which the pressure in the wellbore is increased to above initial fracture pressure of the formation during the fracture induction (in other words, the fracture width is dependent on the pressure difference between the drilling mud and the initial fracture pressure of the formation during the fracture induction step). In a particular embodiment, at least a portion of the bridging material, preferably, a major portion of the bridging material has a particle diameter approaching the width of the fracture mouth. Further, the bridging material may have a broad (polydisperse) particle size distribution; however, other distributions may alternatively be used.

In addition to bridging/propping open the fractures at their mouths, the bridge may also be sealed to prevent the loss of the bridge/material behind the bridge back into the wellbore. Depending on the material and/or particle size distribution selected as the bridging particles, and the material's sealing efficiency, it may be desirable to also include an optional bridge sealing material with the bridging material. However, one of ordinary skill in the art would appreciate that in some instances, a bridging material may possess both bridging and sealing characteristics, and thus, one additive may be both the bridging material and the bridge sealing material. Additionally, the use of a broad particle size distribution (and in particular, inclusion of fine bridging particles) may also be sufficient to seal the bridge formed at the mouth of the fracture. However, it may be desirable in other embodiments to also include a sealing material to further increase the strength of the seal. Additives that may be useful in increasing the sealing efficiency of the bridge may include such materials that are frequently used in loss circulation or fluid loss control applications. For example, such bridge sealing materials may include fine and/or deformable particles, such as industrial carbon, graphite, cellulose fibers, asphalt, etc. Moreover, one of ordinary skill in the art would appreciate that this list is not exhaustive, and that other sealing materials as known in the art may alternatively be used.

Carrier fluids suitable for use in the methods of the present disclosure include those that may set or solidify upon a period of time. The term "settable fluid" as used herein refers to any suitable liquid material which may be pumped or emplaced downhole, and will harden over time to form a solid or gelatinous structure and become more resistance to mechanical deformation. Examples of compositions that may be included in the carrier fluid to render it settable include cementious materials and chemical resin components.

Examples of cementious materials that may be used to form a cement slurry carrier fluid include those materials such as mixtures of lime, silica and alumina, lime and magnesia, silica, alumina and iron oxide, cement materials such as calcium sulphate and Portland cements, and pozzolanic materials such as ground slag, or fly ash. Formation, pumping, and setting of a cement slurry is known in art, and may include the incorporation of cement accelerators, retardants, dispersants, etc., as known in the art, so as to obtain a slurry and/or set cement with desirable characteristics.

In other embodiments, the settable carrier fluid may include a pre-crosslinked or pre-hardened chemical resin components. As used herein, chemical resin components refers to resin precursors and/or a resin product. Thus, similar to cement, the components placed downhole must be in pumpable form, and may, upon a sufficient or predetermined amount of time, harden into a gelatinous or solidified structure. Generally, resins may be formed from a bi- or multicomponent system having at least one monomer that may self- or co-polymerize through exposure to or reaction with a hardening agent which may include a curing agent, initiator, crosslinkant, catalyst, etc. One of ordinary skill in the art would appreciate that there is a multitude of resin chemistry that may be used to in embodiments of the present disclosure, and that the claims should not be limited to any particular type of resin, as the discussion below is merely exemplary of the broad applicability of various types of resins to the methods disclosed herein.

Chemical mechanisms that may be used in the setting of the settable carrier fluids of the present disclosure may include, for example, reaction between epoxy functionalization with a heteroatom nucleophile, such as amines, alcohols, phenols, thiols, carbanions, and carboxylates. Further, in one embodiment, the epoxy functionalization may be present on either the monomer or the hardening agent. For example, as described in U.S. patent application Ser. No. 11/760,524, which is herein incorporated by reference in its entirety, an epoxy-modified lipophilic monomer may be crosslinked with a crosslinkant that comprises a heteroatom nucleophile, such as an amine, alcohol, phenol, thiol, carbanion, and carboxylate. Conversely, in U.S. patent application Ser. No. 11/737,612, which is also herein incorporated by reference in its entirety, various monomer species, such as tannins, lignins, natural polymers, polyamines, etc, that may contain amine or alcohol functionalization, may be crosslinked with varies epoxides, etc. Other resins formed through epoxide chemistry may be described in U.S. Patent Application Ser. Nos. 60/939,733, and 60/939,727, which are herein incorporated by reference in their entirety. However, the present disclosure is not limited to reactions involving epoxide chemistry. For example, it is also contemplated that the breaker systems may also be used in other types of gels, for example, elastomer-type gels, such as polyurethanes and polyureas. Such gels are described, for example, in U.S. Patent Application Nos. 60/942,346 and 60/914,604, and PCT Application Nos. PCT/US08/61272 and PCT/US08/61300, which are assigned to the present assignee and herein incorporated by reference in their entirety. Polyureas and polyurethanes may be formed by the reaction of a blocked isocyanate with an active hydrogen compound, i.e., polyamine and polyol, respectively. Polyurethane gels may also include gels formed from silane end-capped polyurethane prepolymers that may be crosslinked via a moisture cure. Additionally, it is also within the scope of the present disclosure that the elastomeric gels may also contain some isocyanurate functionality therein and/or may be combined with one or more epoxy or other gels to form a hybrid gel.

In one embodiment, a monomer species such as lignins, lignosulfonates, tannins, tannic acids, biopolymers, natural polymers, polyamines, polyether amines, poly vinyl amines and polyethylene imines, modified derivatives thereof, and combinations thereof may be crosslinked with hardening agents such as ethylene glycol diglycidyl ether, propylene glycol diglycidyl ether, butylene glycol diglycidyl ether, sorbitol polyglycidyl ether, aziridine derivatives, epoxy functionalized polyalkalene glycols, an oxidized starch (polymeric dialdehyde), acetals that can be hydrolyzed to produce the aldehyde in situ, and combinations thereof.

In another embodiment, various epoxy-functionalized natural oils, such as soybean oil, linseed oil, rapeseed oil, cashew nut shell oil, perilla oil, tung oil, oiticia oil, safflower oil, poppy oil, hemp oil, cottonseed oil, sunflower oil, high-oleic triglycerides, triglycerides of euphorbia plants, peanut oil, olive oil, olive kernel oil, almond oil, kapok oil, hazelnut oil, apricot kernel oil, beechnut oil, lupin oil, maize oil, sesame oil, grapeseed oil, lallemantia oil, castor oil, herring oil, sardine oil, menhaden oil, whale oil, and tall oil, may be crosslinked with hardening agents comprising amines, alcohols, phenols, thiols, carbanions, and carboxylates, and aliphatic polyamine, polyethylenimine, polyetheramine, modified cycloaliphatic amities in particular. In yet another embodiment, polyamines and polyols may be crosslinked with an isocyanate, including a blocked isocyanate to form a polyurea and polyurethane, respectively. In yet another embodiment, silane end-capped polyurethane prepolymers may be crosslinked via a moisture cure.

In one embodiment, the settability of the carrier fluid is due to the combination of the lipophilic monomer with the crosslinking agent in an appropriate solvent. One of ordinary skill in the art would appreciate that the selection of a particular solvent for the carrier fluid may depend on its compatibility with the resin components selected. Solvents that may be appropriate may comprise oil-based fluids for use in downhole applications and may include mineral oil, diesel, and synthetic oils, or an aqueous-based fluid, such as fresh water, sea water, brine, mixture of water and water soluble organic compounds, and mixtures thereof.

One of ordinary skill in the art would appreciate that the optimal ratios for the monomer species and hardening agent may vary greatly depending on the type of hardening mechanism. Further, the amount of hardening agent may affect the hardness of the resulting gel. For example, in some embodiments, for a constant weight of monomer, increasing the amount of hardening agent may result in a higher crosslink density, and therefore a harder gel. Using the guidelines provided herein, those skilled in the art will be capable of determining a suitable amount of hardening agent to employ to achieve a set gel structure of the desired hardness.

Embodiments disclosed herein may also range in their setting or gellation times. In some embodiments, a gel may form immediately upon mixing of monomers and hardening agents. In other embodiments, a gel may form within 1 minute of mixing; within 5 minutes of mixing in other embodiments; within 30 minutes of mixing in other embodiments. In some embodiments, a gel may form within 1 hour of mixing; within 8 hours in other embodiments; within 16 hours in other embodiments; within 80 hours in other embodiments; within 120 hours in yet other embodiments. Further, one of ordinary skill in the art would appreciate that varying chemical species and ratios of species used, temperatures, and/or incorporation of accelerators and retardants may be used to control setting times of the carrier fluids.

The reaction of the monomer and hardening agent may produce gels having a consistency ranging from a viscous sludge to a hard gel. In some embodiments, the reaction of the gelling agent and the crosslinking agent may result in a soft elastic gel; a firm gel in other embodiments; and a hard gel in yet other embodiments. The hardness of the gel is the force necessary to break the gel structure, which may be quantified by measuring the force required for a needle to penetrate the crosslinked structure. Hardness is a measure of the ability of the gel to resist to an established degree the penetration of a test needle driven into the sample at a constant speed.

Hardness and compressive strength may be measured by using a Brookfield QTS-25 Texture Analysis Instrument. This instrument consists of a probe of changeable design that is connected to a load cell. The probe may be driven into a test sample at specific speeds or loads to measure the following parameters or properties of a sample: springiness, adhesiveness, curing, breaking strength, fracturability, peel strength, hardness, cohesiveness, relaxation, recovery, tensile strength burst point, and spreadability. The hardness and compressive strength may be measured by driving a 4 mm diameter, cylindrical, flat faced probe into the gel sample in a 75 mL glass vial containing approximately 60 mL of test fluid at a constant speed of 30 mm per minute to a depth of 35 mm. When the probe is in contact with the gel, a force is applied to the probe due to the resistance of the gel structure until it fails, which is recorded via the load cell and computer software. As the probe travels through the sample, the force on the probe and the depth of penetration are measured. The force on the probe may be recorded at the initial breakthrough and at various depths of penetration, providing an indication of the gel's overall hardness. For example, the initial peak force may be recorded at the point the gel first fails, close to the contact point, followed by recording highest and lowest values measured after this point where the probe is traveling through the bulk of the gel. In some embodiments, the resulting gel may have a hardness value from 2 to 20000 gram-force. In other embodiments, the resulting gel may be a soft elastic gel having a hardness value in the range from 2 to 20 gram-force. In other embodiments, the resulting gel may be a firm gel having a hardness value from 20 to 100 gram-force. In other embodiments, the resulting gel may range from hard to tough, having a hardness value from 100 to 20000 gram-force; from 300 to 15000 gram-force in other embodiments; from 500 to 10000 gram-force in yet other embodiments; from 1000 to 6000 gram-force in yet other embodiments. In other embodiments, the hardness of the gel may vary with the depth of penetration.

Additionally, for use in the wellbore strengthening application of the present disclosure, it may also be advantageous to control the compressive strength (or hardness) of the gelled or solidified structure within the fracture. That is, to ensure that the set fluid within the fracture and the formed bridge are not lost during subsequent operations, it may be desired to formulate a carrier fluid that upon setting, will have sufficient strength to hold in place, such that extrusion back into the wellbore, as well as transmission of pressure from the wellbore into the fracture, may be avoided. Further, it may also be desirable to use a carrier fluid such that upon setting, the compressive strength is less than the compressive strength of the formation so that the wellbore is not accidentally sidetracked when re-drilling the section and thereby drilling away from the strengthening bridges formed by the methods disclosed herein. Advantageously, the methods of the present disclosure may allow for the selection of a settable carrier fluid that possesses desirable strength characteristics upon setting. In particular, by varying chemical species of the components forming the settable carrier and ratios of the species used, the compressive strength may be controlled. Additionally, it is also within the scope of the present disclosure that the addition of particulate additives, such as weighting agent, may also be used to control the compressive strength of the set fluid.

Thus, one of ordinary skill in the art would appreciate that the desirable strength may depend on the particular formation through which the wellbore, and fractures, are formed; however, such strength requirements may range from, in various embodiments, one-third that of the formation to less than the compressive strength of the formation, and one-half to less than that of the formation in yet other embodiment. However, the inventors of the present disclosure have also recognized that depending on the formation, and the settable carrier fluid selected for use in treating the formation, a compressive strength less than that thought to be required to avoid extrusion back into the wellbore may be sufficient due to chemical adhesion of the set resin in the fracture to the formation.

With respect to the variables listed above (i.e., temperature, time, etc.), those having ordinary skill in light of the disclosure will appreciate that, by using the present disclosure as a guide, properties of the resulting set or gelled structure may be tailored as desired. Further, selection of the carrier fluid may be based on the resulting properties upon setting, including for example, compressive strength, chemical adhesion of the resin to the surrounding formation, etc.

In one embodiment, the fluid of the present disclosure containing a settable carrier fluid and bridging materials may be introduced into the wellbore as a "pill" and may be squeezed into the low permeability formation to be strengthened at a pressure above the initial fracture pressure of the formation so that the bridging particulate material bridges the fractures that are induced in the wellbore wall at or near the mouth thereof. Typically, the pill is squeezed into the formation by sealing the annulus between a drill string and the wellbore wall, running into the hole open ended until the open end is adjacent the target formation zone, and pumping the pill into the wellbore via the drill string, pulling the drill string out of the way, and pressurizing the wellbore until the pressure in the vicinity of the target formation is greater than the initial fracture pressure or re-open pressure (for re-opening fractures) of the formation. The pressure may then be held while the pill sets, which may vary, as described above, depending on the type of settable fluid used. After strengthening the weak formation, the drilling assembly may be run back in the hole and drilling out the remaining pill and the wellbore may be continued using a conventional drilling mud. In future operations, it may be desirable to maintain the pressure in the wellbore in the vicinity of the strengthened formation below the breakdown pressure of the strengthened formation. Future drilling operations may be conducted with either an oil- or water-based drilling fluid, depending on their desirability.

When raising the pressure and inducing (or re-opening) fractures, the bridging material may bridge the induced (or re-opened) fractures within less than 10 seconds, preferably less than 5 seconds from when the fracture opens so that the fracture remains short. While the bridging of the fracture may desirably be short, one of ordinary skill of the art would appreciate that the setting of the carrier fluid need not be limited to such time period. Rather, as described above, the pressure within the wellbore may be held at the elevated level until the pill has set. Rapid sealing of the fracture may mitigate the risk of the fracture propagating.

Further, while the above method describes use of a single pill comprising all components for use in sealing the induced fractures, one of ordinary skill in the art would appreciate that this method may be modified such that at least one of the components for use in sealing the induced fracture may be present in a wellbore fluid used in drilling the wellbore, and thus present in the wellbore prior to placement of a pill. A pill comprising the remainder components may then be spotted to the appropriate location. For example, for gels formed from natural polymers, it may be envisioned that the natural polymers may be present in the drilling fluid, and a hardening agent or crosslinkant may be emplaced subsequently to the region of the formation needing strengthening, such that upon contact of the monomer (natural polymer) with the hardening agent during the pressure increase, the two may react, set, and seal the fracture, as described above.

As noted above, in one embodiment the carrier fluid and/or drilling fluid may be a water based fluid that may include an aqueous fluid selected from the group including sea water, a brine containing organic and/or inorganic dissolved salts, liquids containing water-miscible organic compounds and combinations thereof and similar compounds that should be known to one of skill in the art. Brines suitable for use as the base fluid of the carrier fluid according to various embodiments of the present disclosure may include seawater, aqueous solutions wherein the salt concentration is less than that of sea water, or aqueous solutions wherein the salt concentration is greater than that of sea water. The salinity of seawater may range from about 1 percent to about 4.2 percent salt by weight based on total volume of seawater. The solutions, depending on the source of the seawater typically contain metal salts, such as but not limited to, transition metal salts, alkali metal salts, alkaline earth metal salts, and mixtures thereof. Exemplary salts include halides of zinc, calcium, and mixtures thereof. For example, the solution can include zinc halide, such as zinc bromide or zinc chloride or both, optionally in combination with calcium bromide or calcium chloride or both. Salts that may be found in seawater include, but are not limited to, sodium, calcium, aluminum, magnesium, potassium, strontium, and lithium salts of chlorides, bromides, carbonates, iodides, chlorates, bromates, formates, sulfates, silicates, phosphates, nitrates, oxides, and fluorides. Salts that may be incorporated in a given brine include any one or more of those present in natural seawater or any other organic or inorganic dissolved salts. Additionally, brines that may be used in the drilling fluids disclosed herein may be natural or synthetic, with synthetic brines tending to be much simpler in constitution. In one embodiment, the density of the drilling fluid may be controlled by increasing the salt concentration in the brine (up to saturation). In a particular embodiment, a brine may include halide or carboxylate salts of mono- or divalent cations of metals, such as cesium, potassium, calcium, zinc, and/or sodium. The brine solution can include the salts in conventional amounts, generally ranging from about 1% to about 80%, and preferably from about 20% to about 60%, based on the total weight of the solution, although as the skilled artisan will appreciate, amounts outside of this range can be used as well. In a particular embodiment, the brine may be a $CaCl_2$ and/or $CaBr_2$ brine.

In an alternative embodiment, the carrier fluid and/or drilling fluid may be an oil-based fluid and/or an invert emulsion based fluid that may include a non-oleaginous internal phase and an oleaginous external phase. The oleaginous fluid used for formulating oil-based fluids and/or invert emulsion fluids used in the practice of the present disclosure are liquids and are more preferably a natural or synthetic oil and more preferably, the oleaginous fluid is selected from the group including diesel oil, mineral oil, synthetic oils such as ester based synthetic oils, polyolefin based synthetic oils (i.e., saturated and unsaturated polyalpha olefin, saturated and unsaturated long chain internal olefins), polydiorganosiloxanes, siloxanes or organo-siloxanes, and mixtures thereof and similar compounds that should be known to one of skill in the art.

For invert emulsions, the concentration of the oleaginous fluid should be sufficient so that an invert emulsion forms and may be less than about 99% by volume of the invert emulsion. However, generally the amount of oleaginous fluid must be sufficient to form a stable emulsion when utilized as the continuous phase. In various embodiments, the amount of oleaginous fluid at least about 30 percent, preferably at least about 40 percent, and more preferably at least about 50 percent by volume of the total fluid. In one embodiment, the amount of oleaginous fluid is from about 30 to about 95 percent by volume and more preferably from about 40 to about 90 percent by volume of the invert emulsion fluid.

The non-oleaginous fluid used in the formulation of the invert emulsion based fluids is a liquid and preferably is an aqueous liquid. More preferably, the non-oleaginous fluid may be selected from the group including sea water, a brine containing organic and/or inorganic dissolved salts, liquids containing water-miscible organic compounds and combinations thereof and similar compounds that should be known to one of skill in the art. The amount of the non-oleaginous fluid is typically less than the theoretical limit needed for forming an invert emulsion. In various embodiments, the amount of non-oleaginous liquid is at least about 1, preferably at least about 5, and more preferably greater than about 10 percent by volume of the total fluid. Correspondingly, the amount of the non-oleaginous fluid should not be so great that it cannot be dispersed in the oleaginous phase. Thus, in one embodiment, the amount of non-oleaginous fluid is less than about 70% by volume and preferably from about 1% to about 70% by volume. In another embodiment, the non-oleaginous fluid is preferably from about 10% to about 60% by volume of the invert emulsion fluid.

Various fluids of the present invention may further contain additional chemicals depending upon the end use of the fluid so long as they do not interfere with the functionality of the fluids described herein. For example, wetting agents, weighting agents, organophilic clays, viscosifiers, fluid loss control agents, surfactants, dispersants, interfacial tension reducers, pH buffers, mutual solvents, thinners, thinning agents, scale inhibition agents, corrosion inhibition agents, cleaning agents and a wide variety of the other components known to one of skill in the art may be added to the fluid compositions of this invention for additional functional properties. The addition of such agents and the reasons for doing so should be well known to one of ordinary skill in the art of formulating drilling fluids (also known as drilling muds,) completion fluids, spacer fluids, clean-up fluids, fracturing fluids, and other similar wellbore fluids.

EXAMPLES

Example 1

Formulation

The following example includes an oil-based pill and experimental data showing properties of the set fluid. The pill was formed, using a Hamilton Beach mixer, by mixing and shearing the required quantity of diesel (low sulfur No. 2) and EMI-1160, an epoxy resin available from M-I LLC (Houston, Tex.), for five minutes; adding VG-SUPREMET™, an organoclay viscosifier available from M-I LLC (Houston, Tex.) and shearing until homogenous. The SAFE-CARB® solids, calcium carbonate available from M-I LLC (Houston, Tex.), are then mixed in until homogenous. Prior to use, EMI-1161, a polyamine and EMI-1162, an amine blend, both available from M-I LLC. (Houston, Tex.), are mixed in until homogenous. The pill components are listed in Table 1 below.

TABLE 1

| Component | Quantity |
|---|---|
| Diesel oil | 0.137 bbl/lbbl |
| VG-SUPREME ™ | 3.50 ppb |
| EMI-1160 | 0.43 bbl/lbbl |
| SAFE-CARB ® 40 | 105.60 ppb |
| SAFE-CARB ® 250 | 20.00 ppb |
| SAFE-CARB ® 500 | 25.00 ppb |
| G-SEAL ® | 25.00 ppb |
| EMI-1161 | 76 ppb |
| EMI-1162 | 7.4 ppb |

Temperature and Pressure Effects

Rheological measurements of the gelled pill at temperature and ambient pressure were obtained using a GRACE M3500 viscometer, in combination with a standard B1/F1 bob and spring. Shear rates of 17 $sec^{-1}$ were used throughout as this was close to the average shear rate calculated at the wall of the pipe. This assumed a constant pump rate of 5 bbl/min.

Figure 2:
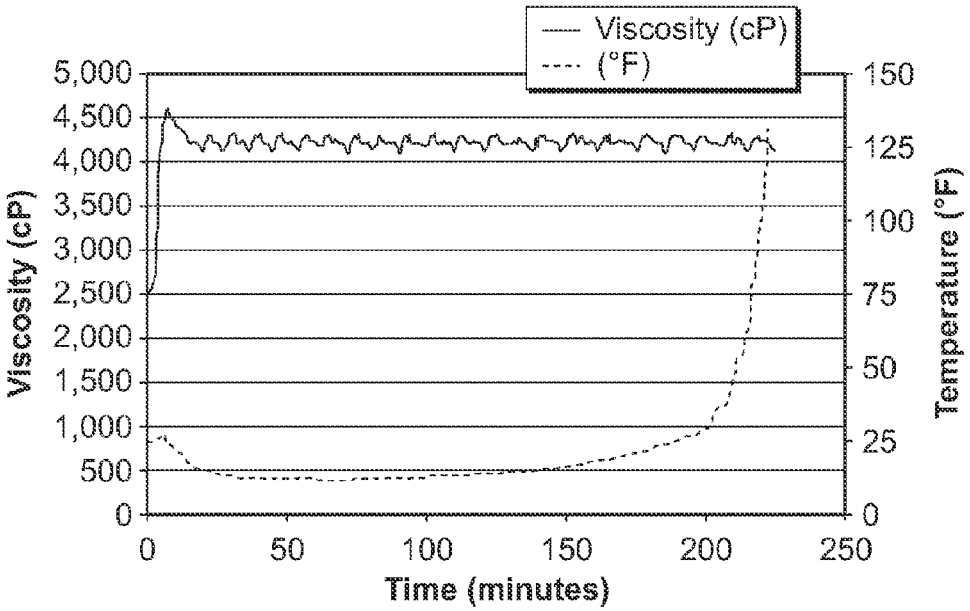
FIG. 2. shows a graphical representation of the effect of temperature on curing of a settable fluid of the present disclosure.
Figure 3:
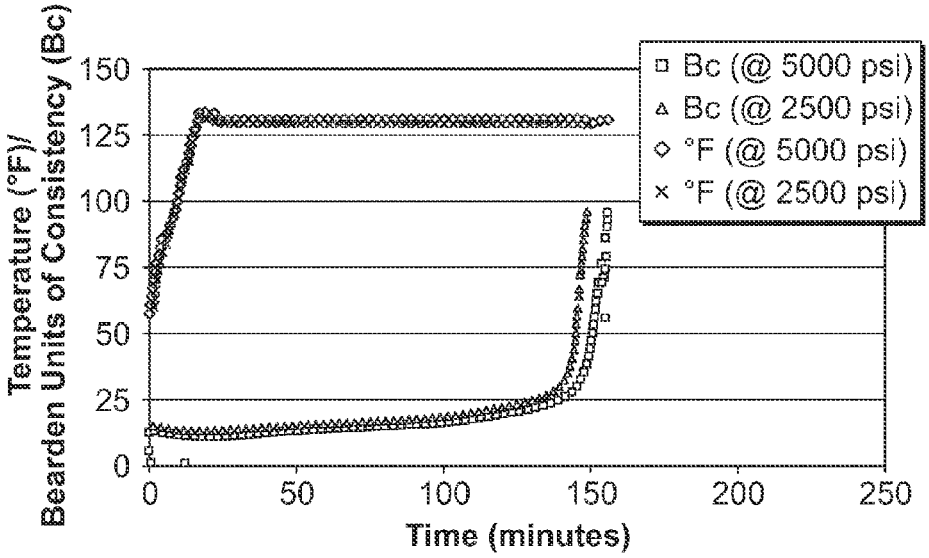
FIG. 3 shows a graphical representation of the effect of pressure on curing of a settable fluid of the present disclosure.

To assess the later stages of the curing process, a NOWSCO PC10 portable consistometer was used. This was operated at various temperatures, and at pressures up to 5000 psi. Later in-situ measurements at the trial site determined a BHST of 107° F. which was considerably cooler than expected. The downhole hydrostatic pressure as determined from mud weight was estimated to be 1944 psi, although this was liable with squeeze pressures to increase to over 4000 psi. The effects of temperature and pressure can be seen in FIGS. 2 and 3, respectively.

Specifically, when comparing the ambient pressure curing profiles of the fully formulated stress cage gel against those obtained using the consistometer at both 2500 psi and 5000 psi, the higher pressures were found to accelerate the right-angle set-time by approximately 30% (at 127° F.) from 200 minutes to 140 minutes. It was noted that very little difference was observed between the two higher pressures, this possibly reflecting upon the upper limit of compression achievable by the fully formulated pill.

Compressive Strength

The compressive strength of the cross-linked gel was determined, both with and without solids, using a Brookfield QTS 25 texture analyzer fitted with a 4 mm diameter cylindrical probe. Compressive strengths were obtained by measuring the maximum compressive force attained when the cylindrical probe was inserted at constant velocity to a depth of 35 mm into a 75 mL glass vial containing approximately 60 mL of the test fluid. Displacement velocities of 30 mm per minute were utilized throughout and the bulk of tests were performed under ambient conditions.

Figure 4:
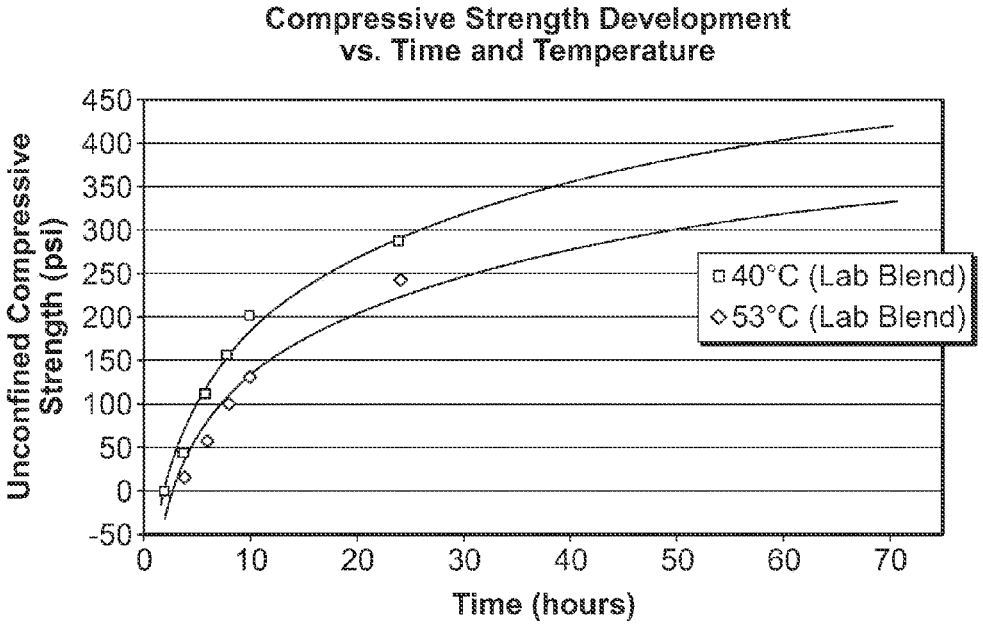
FIG. 4 shows a graphical representation of the effect of time and temperature on compressive strength of a settable fluid of the present disclosure.

The development of compressive strength over time at differing temperatures for the solids-laden gel can be seen in FIG. 4. As shown in FIG. 4, it was found that over a defined period, the compressive strength of the gel increases with increasing temperature. Generally, it was also concluded that compressive strength increases with solids loading.

Adherence to Formation

A Positester device, a "Type V" self-aligning digital pull-off adhesion tester described in ASTM D4541-02 was used to ascertain the relative adhesive qualities of the gel to an oil-based drilling fluid wetted slate. Slate, of English provenance, was ultimately selected as the base material for the adhesion tests. Testing involved first wetting the slate with a thin layer of the oil-based drilling fluid selected for drilling the shale section of the well. A few drops, enough to form a thin film, of the gel formulation were then placed onto the surface of a 20 mm diameter circular disc of slate. This had been previously glued to the base of an aluminum dolly of the type used by the test apparatus. The dolly was then pressed lightly onto the oil-wetted slate, and the whole assembly placed in an oven overnight at the required temperature. Adhesion values were obtained using a "Type V" self-aligning adhesion tester, with the bulk of tests being performed in duplicate. Adhesion values in excess of 70 psi were routinely obtained with the field formulations, as compared to more conventional (water-based) lost circulation pills.

Field Trial

A field trial was conducted to test the gel system of this Example to try to form a stress cage and achieve a permanent strengthening effect for a wellbore through a shale formation. The test was conducted in a vertical well, across 50 ft of shale in an 8¾" hole at approx. 4020 ft. The shale was directly below the 9⅝" casing shoe. The formation is fairly un-reactive brittle shale. The mud type was diesel OBM with a mud weight of 9.3 ppg.

The following procedure was used: a) cement casing and perform casing integrity test; b) drill out 30 ft of shale (8¾" hole); c) run extended leak off test for formation in base mud; d) measure fracture reopening pressure; e) pull drilling assembly out of hole and run temperature log to determine bottom hole static temperature (BHST); e) run in hole open ended, place pill, pull above and reverse circulate clean; 1) squeeze pill to a pressure above the initial breakdown pressure, hold pressure for sufficient time for pill to set; g) pull out of hole, run back in with drilling assembly and drill out pill, leaving 10 ft in the bottom; and h) perform a series of FIT tests after circulating for increasing lengths of time to test survival of the stress cage pill.

Extended Leak Off and BHST

Figure 5:
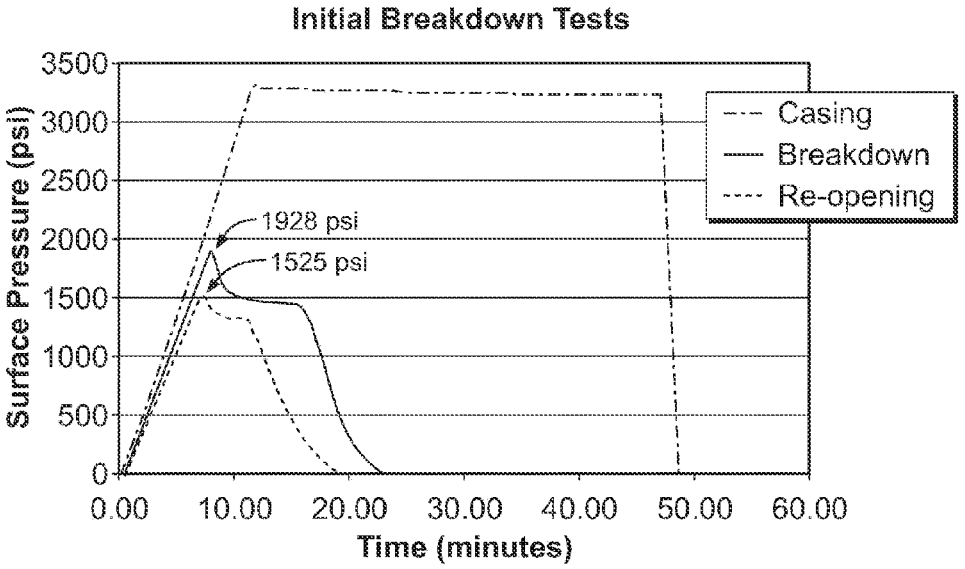
FIG. 5 shows a graphical representation of an extended leak-off test in a shale formation.
Figure 6:
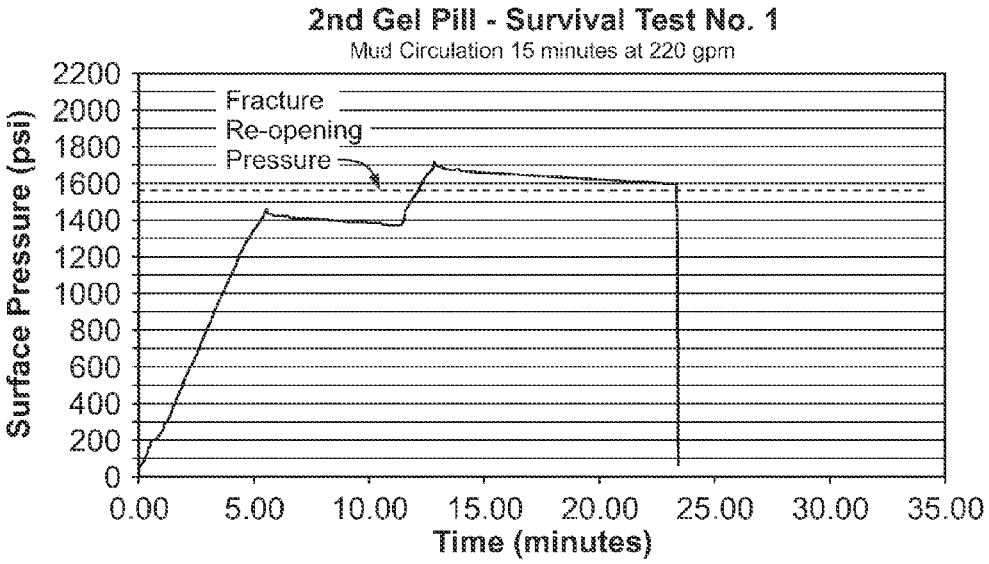
FIGS. 6-9 show graphical representations of formation integrity tests following formation of a stress cage in accordance with one embodiment of the present disclosure.
Figure 7:
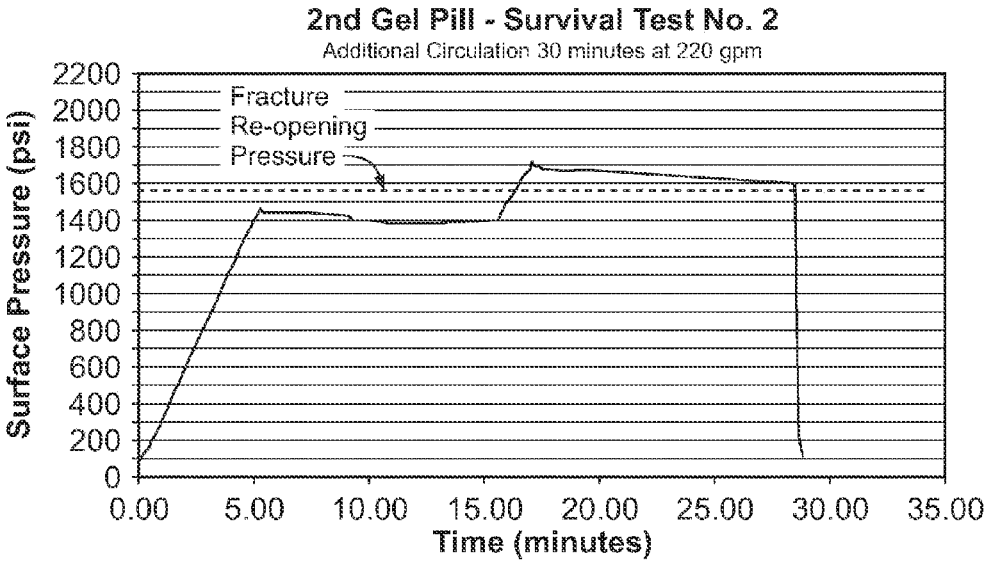
Figure 8:
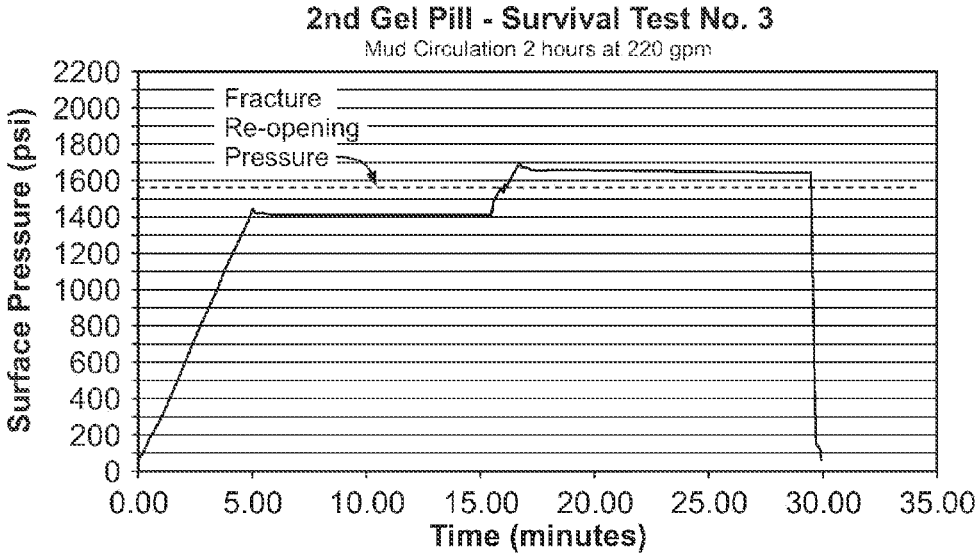

As shown in FIG. 5, the baseline data for the formation breakdown pressure was 1928 psi and on shut-in the pressure bled back to around 1500 psi. On re-pressurization, the re-opening pressure was around 1525 psi. The difference between breakdown and re-opening of about 400 psi (1928-1525 psi) is the tensile strength of the rock.

The BHST was logged as 107° F. which is considerably lower than the estimated 120-127° F. for the well. Knowing the BHST accurately enabled the gel formulation to be optimized at the rig site, although with the temperature lower than expected the setting times were longer than originally planned. Rather than re-designing the chemistry of the pill, the decision was made to extend the shut-in period for setting of the gel to around 20 hours.

Pill Placement

The bridging package for the pill was designed by running in-house software, which predicts fracture widths from petrophysical data. A fracture opening width of 0.64 mm was predicted for the wellbore pressure to exceed the minimum horizontal stress by 500 psi. The bridging solids design and the field trial procedures were based around this prediction. In particular, a wide range (−2 to 800 microns) of bridging solids were used, allowing for possible variations in fracture width and ensuring that a good seal was obtained on the fracture.

A balanced plug technique was used. The procedure was to pump 10 bbls diesel spacer, followed by 16 bbls of treatment (10.5 ppg), followed by 2 bbls diesel so that column heights/densities were balanced in the annulus and drill pipe after displacement. Foam wiper balls were placed either side of the treatment.

A squeeze pressure of 2500 psi was used. This climbed to around 3000 psi surface pressure towards the end of the 19 hr squeeze period, perhaps due to rising downhole temperature or heating of surface lines (night versus day temperatures). It was noted that the formulated pill could hold 2500 psi whilst still fully liquid, considering the initial breakdown pressure was 1928 psi.

After drilling out, periods of mud circulation followed by formation integrity testing (FIT testing) was used to assess the survival of the treatment. The tests are shown in Table 2 below.

TABLE 2

| Survival Test | Mud circulation time (hrs) | Cumulative circulation time (hrs) | Circulation rate (gal/min) | Test pressure (FIT) after circulation (psi) |
|---|---|---|---|---|
| 1 | 0.25 | 0.25 | 220 | 1700 |
| 2 | 0.5 | 0.75 | 220 | 1700 |
| 3 | 2.0 | 2.75 | 220 | 1700 |
| 4 | 2.0 | 4.75 | 440 | 2080 |

During circulation, the BHA was rotated and moved up and down through the strengthened shale to avoid wash-out in one particular zone. The FIT results are shown in FIGS. 6-9. After mud circulation, the FIT pressure was taken to 1400 psi initially to establish a base line. In survival tests 1-3, shown in FIGS. 6-8, the pressure was then increased to 1700 psi, which is 175 psi above the original fracture re-opening pressure shown in FIG. 5.

Figure 9:
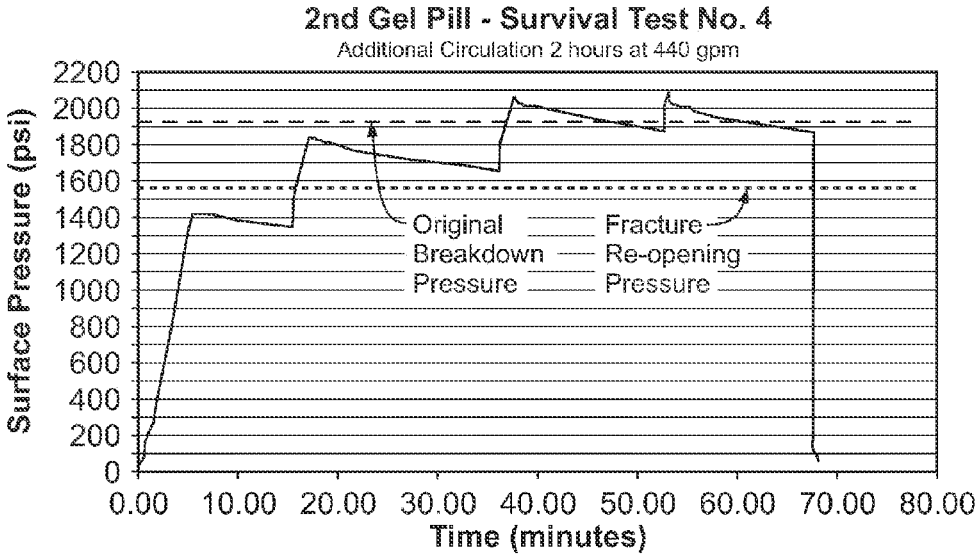

Survival tests 1-3 were successful and suggested a prolonged strengthening effect had been achieved; the total circulation time was 2.75 hrs, although circulation had been at half normal rate at 220 gal/min. For a more severe test (survival test 4) the circulation rate was increased to 440 gal/min, and after 2 hrs of circulation a final series of FIT tests was carried out as shown in FIG. 9. The surface pressure was increased in stages and reached 2080 psi before the fourth survival test was terminated, which is approximately 150 psi above the original formation breakdown pressure (1928 psi), and an impressive 550 psi above the fracture re-opening pressure.

Example 2

In another example, casing was set at 2388 feet. The shoe was drilled out and tested to demonstrate a native formation strength of 988 psi above mud hydrostatic or 17.32 ppg. The well was drilled to expose 90 feet of shale formation and the leak-off test was re-run to confirm a native strength of 17.04 ppg.

A cement pill was placed across the entire open hole with a stress cage formulation containing 25 lbs/bbl BARACARB® 600, ground marble, 5 lbs/bbl BARACARB® 150 and 10 lbs/bbl STEEL-SEAL® regular, industrial carbon, all of which are available from Baroid Fluid Services (Houston, Tex.). Water content in the cement was adjusted to produce a 1000 psi compressive strength at the time the hole was redrilled. The cement/stress cage pill was squeezed into place and pressure held while the cement set. The hole was redrilled (all but the last 10 feet). A leak-off was run to a pressure of 1179 psi above mud hydrostatic or 18.58 ppg. 18.58 ppg was the anticipated overburden at this depth or the maximum possible strength that could be achieved before introducing horizontal fractures.

Advantageously, embodiments of the present disclosure may provide for at least one of the following. Conventional wisdom in the field of wellbore strengthening has long asserted that low permeability formations such as shale could not be strengthened using a stress cage approach. However, embodiments discloses herein allow for a method of strengthening such low permeability formations. Specifically, embodiments disclosed herein may provide a means for increasing the fracture resistance of a formation and strengthening weak regions of a wellbore so that the well may be drilled using a higher mud weight than could normally be used without inducing fractures. Further, such techniques may allow for more economical and efficient drilling, particularly in depleted sand zones neighbored by or inter-bedded with shales.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A method of increasing the fracture resistance of a low permeability formation, comprising:

emplacing a wellbore fluid in a wellbore through the low permeability formation having a permeability of less than about 1 mD, the wellbore fluid comprising:

a settable carrier fluid; and a solid particulate bridging material;

squeezing the wellbore fluid into the low permeability formation at a pressure above an initial or a re-opening fracture pressure of the formation such that fractures are formed in the formation;

allowing the wellbore fluid to enter the fractures;

bridging and sealing the mouths of the fractures with the solid particulate bridging material of the wellbore fluid to form a substantially impermeable bridge proximate the mouth of the fractures thereby strengthening the formation; and holding the increased pressure for an amount of time sufficient for setting of the settable carrier fluid of the wellbore fluid in the fractures.

2. The method of claim 1, wherein the pressure is above the initial fracture pressure of the formation to induce fractures in the wellbore.

3. The method of claim 1, wherein the pressure is above the re-opening pressure of the formation to re-open fractures in the wellbore.

4. The method of claim 1, wherein the bridging and sealing prevents fracture propagation.

5. The method of claim 1, wherein the solid particulate bridging material bridges and seals the mouth of the fracture.

6. The method of claim 1, wherein the wellbore fluid further comprises a bridge sealing material to seal the bridge proximate the mouth of the fracture.

7. The method of claim 1, wherein the solid particulate bridging material comprises at least one of calcium carbonate, graphite, dolomite, celluloses, micas, sand, and ceramic particles.

8. The method of claim 1, wherein the set carrier fluid possesses a compressive strength sufficient to prevent extrusion of the set fluid out of the fracture.

9. The method of claim 1, wherein the set carrier fluid comprises a compressive strength less than that of the formation.

10. The method of claim 1, wherein the set carrier fluid comprises a compressive strength ranging from one-third of to less than a compressive strength of the formation.

11. The method of claim 1, wherein the low permeability formation comprises shale.

12. The method of claim 7, wherein the settable carrier fluid chemically adheres to the shale.

13. The method of claim 1, wherein the settable carrier fluid comprises cementious material.

14. The method of claim 1, wherein the settable carrier fluid comprises at least one monomer and a hardening agent.

15. The method of claim 14, wherein the settable carrier fluid comprises at least one epoxide and at least one polyamine.

16. The method of claim 14, wherein the settable carrier fluid comprises at least one epoxidized natural oil and at least one polyetheramine.

17. The method of claim 1, wherein bridging and sealing the mouths of the fractures with the solid particulate bridging material creates a stress cage that increases the hoop stress around the wellbore.

18. The method of claim 1, wherein the settable carrier fluid sets around the solid particulate bridging material and prevents the loss of the substantially impermeable bridge back in to the wellbore.

19. The method of claim 1, wherein the settable carrier fluid comprises one or more components that react to form covalent bonds between the one or more components.

20. A method of drilling a wellbore through a low permeability formation, comprising:

drilling the wellbore while circulating a first wellbore fluid into the wellbore;

emplacing a second wellbore fluid in a wellbore through the low permeability formation having a permeability of less than about 1 mD, the second wellbore fluid comprising:

a settable carrier fluid; and a solid particulate bridging material;

squeezing the wellbore fluid into the low permeability formation at a pressure above an initial or a re-opening fracture pressure of the formation such that fractures are formed in the formation;

allowing the second wellbore fluid to enter the fractures;

bridging and sealing the mouths of the fractures with the solid particulate bridging material of the second wellbore fluid to form a substantially impermeable bridge proximate the mouth of the fractures thereby strengthening the formation; and holding the increased pressure for an amount of time sufficient for setting of the settable carrier fluid of the second wellbore fluid in the fractures.

21. The method of claim 20, wherein the settable carrier fluid comprises one or more components that react to form covalent bonds between the one or more components.

22. The method of claim 20, wherein the pressure is above the initial fracture pressure of the formation to induce fractures in the wellbore.

23. The method of claim 20, wherein the pressure is above the re-opening pressure of the formation to re-open fractures in the wellbore.

24. The method of claim 20, wherein the bridging and sealing prevents fracture propagation.

25. The method of claim 20, wherein the solid particulate bridging material bridges and seals the mouth of the fracture.

26. The method of claim 20, wherein the second wellbore fluid further comprises a bridge sealing material to seal the bridge proximate the mouth of the fracture.

27. The method of claim 20, wherein the solid particulate bridging material comprises at least one of calcium carbonate, graphite, dolomite, celluloses, micas, sand, and ceramic particles.

28. The method of claim 20, wherein the set carrier fluid possesses a compressive strength sufficient to prevent extrusion of the set fluid out of the fracture.

29. The method of claim 20, wherein the set carrier fluid comprises a compressive strength less than that of the formation.

30. The method of claim 20, wherein the set carrier fluid comprises a compressive strength ranging from one-third of to less than a compressive strength of the formation.

31. The method of claim 20, wherein the low permeability formation comprises shale.

32. The method of claim 20, wherein the settable carrier fluid comprises cementious material.

33. The method of claim 20, wherein the settable carrier fluid comprises at least one monomer and a hardening agent.

34. The method of claim 33, wherein the settable carrier fluid comprises at least one epoxide and at least one polyamine.

35. The method of claim 33, wherein the settable carrier fluid comprises at least one epoxidized natural oil and at least one polyetheramine.

36. A method of increasing the fracture resistance of a low permeability formation, comprising:

emplacing a wellbore fluid in a wellbore through the low permeability formation having permeability of less than about 1 mD, the wellbore fluid comprising:

a settable carrier fluid comprising:

an oleaginous base fluid;

an epoxidized natural oil; and at least one crosslinking agent;

a solid particulate bridging material; and a bridge sealing material;

squeezing the wellbore fluid into the low permeability formation at a pressure above an initial or re-opening fracture pressure of the formation such that fractures are induced in the formation;

allowing the wellbore fluid to enter the fractures, the solid particulate bridging material of the wellbore fluid to prop open the fractures, and the bridge sealing material of the wellbore to form a substantially fluid impermeable bridge proximate the mouths of the fractures, thereby strengthening the formation and preventing the fractures from further growth in length; and holding the increased pressure for an amount of time sufficient for setting of the settable carrier fluid of the wellbore fluid in the fractures.

37. A method of increasing the fracture resistance of a low permeability formation, comprising:

emplacing a wellbore fluid in a wellbore through the low permeability formation having a permeability of less than about 1 mD, the wellbore fluid comprising:

a settable carrier fluid comprising:

water; and a cementious material;

a solid particulate bridging material; and a bridge sealing material;

squeezing the wellbore fluid into the low permeability formation at a pressure above an initial or re-opening fracture pressure of the formation such that fractures are induced in the formation;

allowing the wellbore fluid to enter the fractures, the solid particulate bridging material of the wellbore fluid to prop open the fractures, and the bridge sealing material of the wellbore fluid to form a substantially fluid impermeable bridge proximate the mouths of the fractures, thereby strengthening the formation and preventing the fractures from further growth in length; and holding the increased pressure for an amount of time sufficient for setting of the settable carrier fluid of the wellbore fluid in the fractures.

* * * * *